United States Patent [19]

Nakata

[11] Patent Number: 4,467,949

[45] Date of Patent: Aug. 28, 1984

[54] PAPER FEED DEVICE FOR PRINTER

[75] Inventor: Shinichi Nakata, Yokohama, Japan

[73] Assignee: Canon Kabushiki Kaisha, Tokyo, Japan

[21] Appl. No.: 424,540

[22] Filed: Sep. 27, 1982

[30] Foreign Application Priority Data

Oct. 9, 1981 [JP] Japan ..... 56-161891

[51] Int. Cl.[3] ..... B65H 25/02

[52] U.S. Cl. ..... 226/45; 400/611; 242/57; 250/571

[58] Field of Search ..... 226/38, 45; 400/611-625, 320; 318/565, 599, DIG. 1, 363; 235/92 V, 92 K, 92 RB, 92 PK, 92 GT; 250/548, 571; 242/57, 57.1

[56] References Cited

U.S. PATENT DOCUMENTS 3,755,726 8/1973 Knipe ..... 318/563

3,917,142 11/1975 Guarderas ..... 226/38

*Primary Examiner*—Leonard D. Christian

*Attorney, Agent, or Firm*—Fitzpatrick, Cella, Harper & Scinto

[57] ABSTRACT

A paper feed device for the printer of an electronic calculator or the like, has a paper detector which comprises a light-emitting diode and a phototransistor having registered optical axes. If a paper sheet is not detected when a paper feed key or the like is depressed, the paper sheet feed operation continues, even after the paper feed key is released, until the paper detector detects the paper sheet. Operability of paper feed is improved. The rest position in the printer of the leading edge of the paper sheet is determined by the position of the paper detector to thereby determine a constant printing position for the paper.

18 Claims, 3 Drawing Figures

PAPER FEED DEVICE FOR PRINTER

BACKGROUND OF THE INVENTION

1. Field of the Invention

The present invention relates to a printer and, more particularly, to a paper feed device for a printer.

2. Description of the Prior Art

In the printer of a conventional electronic calculator or the like, the operator depresses a paper feed key with one hand to operate the paper feed mechanism of the printer while he inserts the edge of the paper sheet into the opening of a printer paper insertion section with his other hand. However, with this system, since the edge of the paper sheet must be carried to the edge of the printer paper insertion opening with one hand, operation is complex and difficult.

SUMMARY OF THE INVENTION

It is an object of the present invention to provide a paper feed device for a printer, which provides improved operation for inserting a paper sheet.

It is another object of the present invention to provide a paper feed device for a printer, which has a paper detector arranged in the vicinity of a paper output port for detecting the paper sheet, such that, when a specific key such as a paper feed key is depressed and a paper sheet is not detected by the paper detector, paper feed operation may be continued, even after the specific key is released, until the paper sheet is detected by the paper detector.

In accordance with an aspect of the present invention, there is provided a paper feed device for a printer, comprising instructing means for instructing paper feed; holding means for holding an instructed state established by the instructing means; driving means for driving feed of a paper sheet during a period of the instructed state held by the holding means; and paper detecting means, arranged in the vicinity of a paper output port from the printer, for detecting a paper sheet fed by the driving means and for releasing the instructed state held by the holding means upon detection of the paper sheet.

In accordance with another aspect of the present invention, there is also provided a paper feed device for a printer, comprising instructing means for instructing paper feed; holding means for holding an instructed state established by the instructing means; pulse generating means for producing a pulse train during a period of the instructed state held by the holding means; driving means for driving feed of a paper sheet in response to the pulse train generated by the pulse generating means; and paper detecting means; arranged in the vicinity of a paper output port from the printer, for detecting the paper sheet fed by the driving means and for releasing the instructed state held by the holding means upon detection of the paper sheet.

The above and other objects of the present invention will become apparent from the following description when taken in conjunction with the accompanying drawings.

DETAILED DESCRIPTION OF THE PREFERRED EMBODIMENTS

The preferred embodiment of the present invention will now be described with reference to the accompanying drawings.

Figure 1:
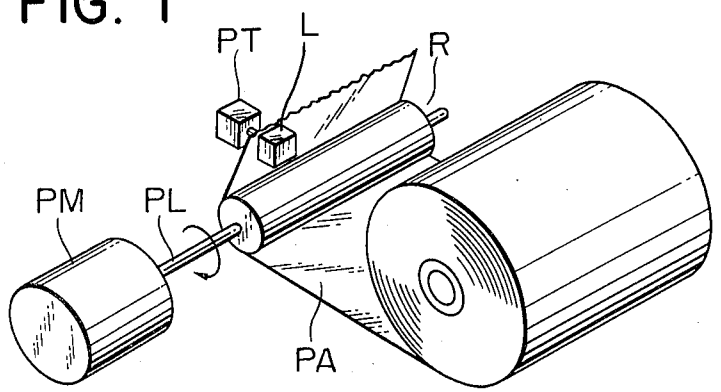
FIG. 1 is a perspective view of a paper feed device for a printer according to the present invention.

FIG. 1 is a perspective view of a paper feed device for a printer according to an embodiment of the present invention. Referring to FIG. 1 a pulse motor PM directly drives a pinch roller R through a rotating shaft PL. The optical axes of a light-emitting diode L and a phototransistor PT are aligned with each other. If a paper sheet PA is not present between the light-emitting diode L and the phototransistor PT, light emitted by the light-emitting diode L turns on the phototransistor PT. However, when a paper sheet PA is inserted between the light-emitting diode L and the phototransistor PT, the paper sheet PA shields the light from the light-emitting diode L and the phototransistor PT is turned off. The phototransistor PT and the light-emitting diode L which accordingly comprise a paper detector, are arranged in the vicinity of the paper output port of the printer.

Figure 2:
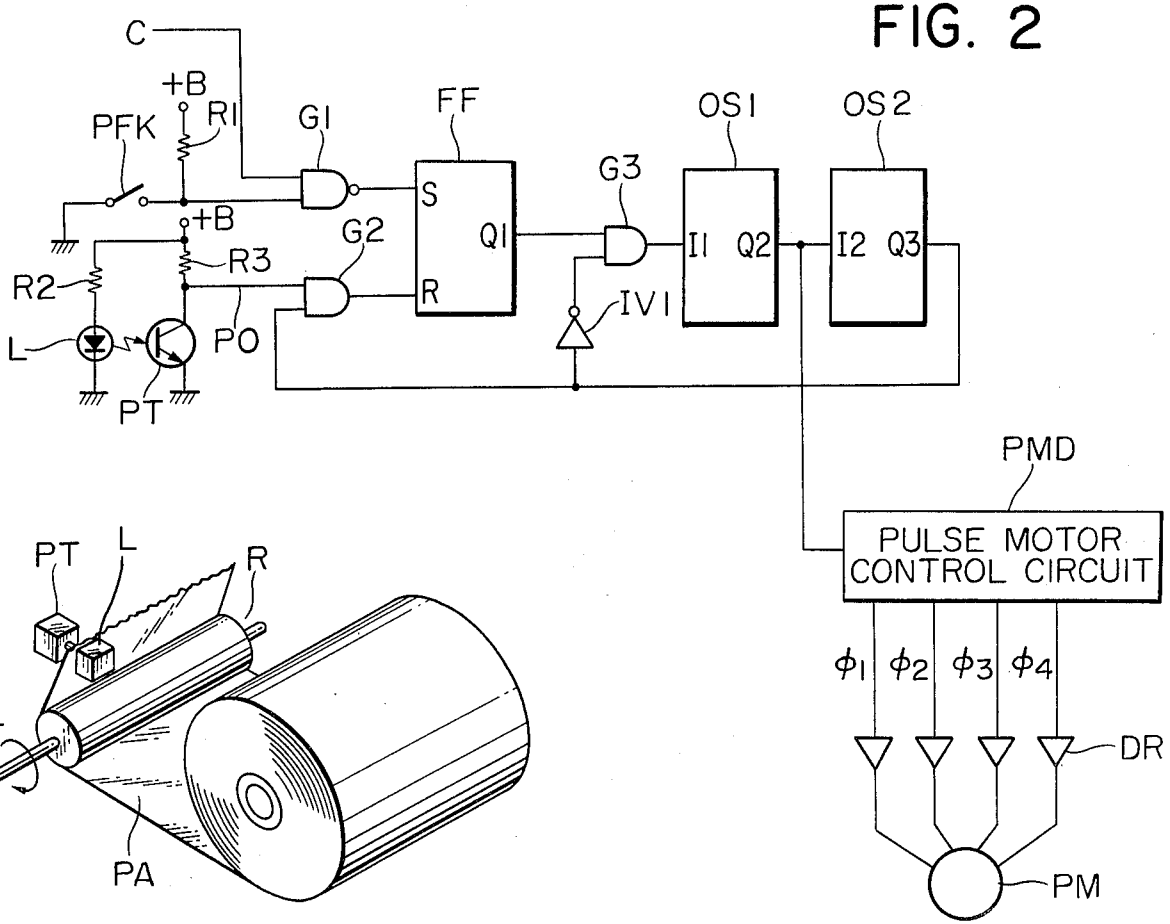
FIG. 2 is a circuit diagram of the paper feed device for a printer shown in FIG. 1.
Figure 3:
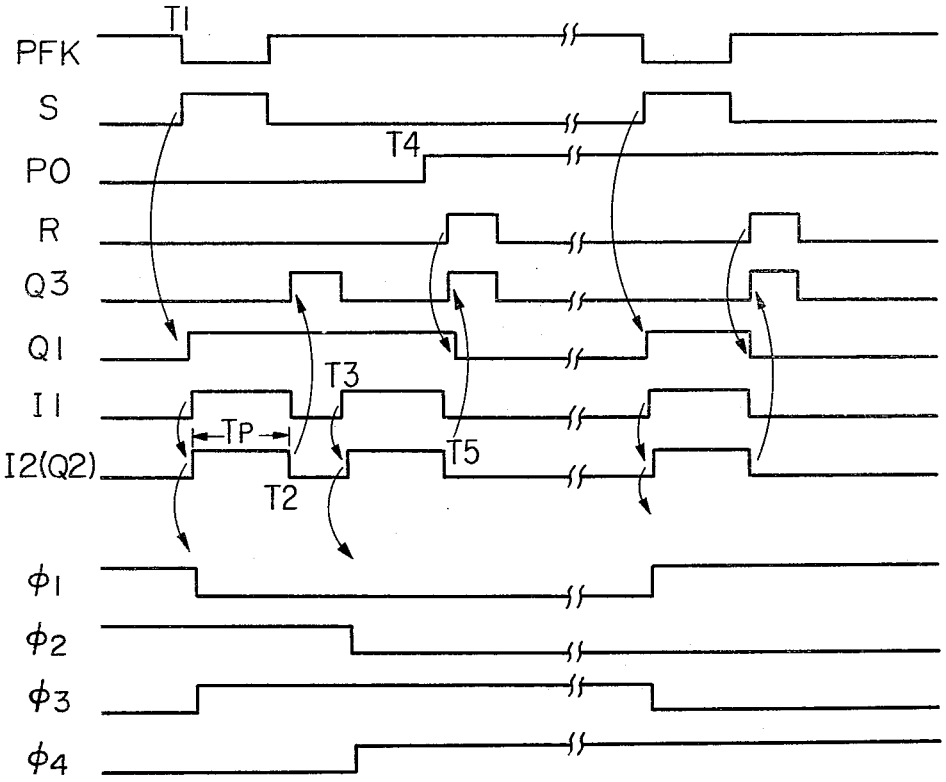
FIG. 3 is a graph that shows timing charts of the signals of the circuitry shown in FIG. 2.

FIG. 2 is a circuit diagram of the paper feed device for a printer according to the embodiment of the present invention. Referring to FIG. 2. a paper feed key PFK is arranged on an apparatus such as an electronic calculator or the like equipped with a printer in accordance with the present invention. The light-emitting diode L is connected to a DC power source B through a resistor R2. The collector of the phototransistor PT is connected to the DC power source B through a resistor R3, and its emitter is grounded. A paper feed signal C normally of logic level "1" from a printer main body is supplied to one input terminal of a NAND gate G1. The other input terminal of the NAND gate G1 is connected to the DC power source B through the resistor R1 and to the paper feed key PFK. One input terminal of an AND gate G2 is connected to the collector of the phototransistor PT, and its other input terminal receives a signal from a one shot circuit OS2 to be described later. A set terminal S of an SR flip-flop FF is connected to the output terminal of the NAND gate G1, and its reset terminal R is connected to the output terminal of the AND gate G2. One input terminal of an AND gate G3 is connected to an output terminal Q1 of the FF, while its other input terminal is connected to the output terminal of an inverter IV1. The input terminal of the inverter IV1 is connected to an output terminal Q3 of the one shot circuit OS2. The output terminal of the AND gate G3 is connected to an input terminal I1 of a one shot circuit OS1. Upon reception of a signal from the AND gate G3, the one shot circuit OS1 produces from its output terminal Q2 a pulse as shown in timing chart at I2(Q2) of FIG. 3. The output terminal Q2 of the one shot circuit OS1 is connected to an input terminal I2 of a one shot circuit OS2. Upon reception of the signal from the one shot circuit OS1, the one shot circuit OS2 produces from its output terminal Q3 a pulse as shown in FIG. 3 at (Q3). A pulse motor control circuit PMD controls the 4-phase motor PM. When the pulse from the one shot circuit OS1 is supplied to the pulse motor control circuit PMD, signals as shown in FIG. 3 ($\phi 1$, $\phi 2$, $\phi 3$ and $\phi 4$) are supplied to the 4-phase pulse motor PM through drivers DR, respectively.

The mode of operation of the circuitry will be described with reference to the timing charts shown in FIG. 3 for the case wherein the paper feed key PFK is depressed when the paper sheet is not inserted into the printer. When the paper feed key PFK is depressed, the signal supplied to the other input terminal of the NAND gate G1 goes to logic level "0".

As is described earlier, the paper feed signal C from the printer main body is supplied to the one input terminal of the NAND gate G1. The paper feed signal C is normally at logic level "1". Thus, since the signal of logic level "1" is supplied to the one input terminal of the NAND gate G1 and the signal of logic level "0" is supplied to the other input terminal, the NAND gate G1 produces a signal of a logic level "1". The output signal from the NAND gate G1 is supplied to the set input terminal S of the FF, and a signal of logic level "1" is produced from the output terminal Q1 of the FF (time T1 in FIG. 3). This signal of logic level "1" is supplied to the one input terminal of the AND gate G3, while the signal from the output terminal Q3 of the one shot circuit OS2 is supplied to the other input terminal of the AND gate G3 through the inverter IV1. Since the output signal from the one shot circuit OS2 is of logic level "0", it is inverted to logic level "1" by the inverter IV1 and is then supplied to the other input terminal of the AND gate G3. Therefore, the AND gate G3 produces a signal of logic level "1" which is supplied to the input terminal I1 of the one shot circuit OS1. The one shot circuit OS1 is triggered by the leading edge of the input signal, and the output signal from the output terminal Q2 of the one shot circuit OS1 to logic level "1". The pulse motor control circuit PMD advances by one the phases of four outputs to the 4-phase pulse motor PM at the leading edge of the signal produced from the output terminal Q2, thus feeding the paper sheet. The signal output period of the one shot circuit OS1 is set to substantially equal the time taken to complete rotation of the pulse motor by one phase. This time period will be defined as Tp. After the elapse of the time period Tp from time T1, the signal from the output terminal Q2 of the one shot circuit OS1 goes to logic level "0" (time T2 in FIG. 3). Since the one shot circuit OS2 is triggered by the trailing edge of the signal input to the input terminal I2, it is triggered at the trailing edge (time T2) of the output from the one shot circuit OS1. The signal output period of the one shot circuit OS2 is set to be short enough to be negligible with reference to the period Tp of the one shot circuit OS1. The output signal from the one shot circuit OS2 is supplied to the AND gate G3 through the inverter IV1. Therefore, the output signal from the AND gate G3, that is, the signal suplied to the input terminal I1 of the one shot circuit OS1, is of logic level "0". The output signal from the output terminal Q3 of the one shot circuit OS2 is also supplied to the other input terminal of the AND gate G2. The output from the phototransistor PT which is turned on upon reception of the light from the light-emitting diode L is supplied to the one input terminal of the AND gate G2. Since the paper sheet has not at this point reached the position of the paper detector comprising the light-emitting diode L and the phototransistor PT, the phototransistor PT remains ON, and a signal of logic level "0" is supplied to the AND gate G2. Therefore, the signal of logic level "0" continues to be produced from the AND gate G2 irrespective of the state of the output signal from the output terminal Q3 of the one shot circuit OS2. At the trailing edge of the output from the output terminal Q3 of the one shot circuit OS2, the signal supplied from the AND gate G3 to the input terminal I1 of the one shot circuit OS1 changes from logic level "0" to logic level "1" to trigger the one shot circuit OS1 (time T3 in FIG. 3). This operation cycle is repeated until the paper sheet reaches the position of the paper detector. When the paper sheet shields the light from the light-emitting diode L, the phototransistor Pt is turned off and produces a signal of logic level "1" (time T4 in FIG. 3). With the output signal of logic level "1" from the output terminal Q3 of the one shot circuit OS2 obtained when the output signal PO from the phototransistor PT goes to logic level "1", the state of the AND gate G2 is different from that when the paper sheet is not fed. That is, since the output signal PO from the phototransistor PT is of logic level "1", the AND gate G2 gates the output signal from the output terminal Q3 of the one shot circuit OS2 to the reset input terminal R of the FF. When the input signal to the reset input terminal R goes to logic level "1", the signal produced from the output terminal Q1 of the FF goes from logic level "1" to logic level "0" (time T5 in FIG. 3). Since the output signal from the output terminal Q1 of the FF is supplied to the one input terminal of the AND gate G3, the AND gate G3 produces a signal of logic level "0" irrespective of the state of the signal from the output terminal Q3 of the one shot circuit OS2. Thus, the one shot circuit OS1 is not triggered by the trailing edge of the signal from the output terminal Q3 of the one shot circuit OS2, and the paper feed operation is interrupted.

In summary, according to the present invention, a paper detector is incorporated in the vicinity of the paper output port of the printer. When the paper sheet is not detected by the paper detector upon depression of a specific key such as a paper feed key, the paper feed operation continues, even after the specific key is released, until the paper detector detects the paper sheet. Therefore, the operation of the device to insert paper into the printer is improved. Since the position of the leading edge of the paper sheet is determined by the position of the paper detector, the printing position may be kept constant for individual printed slips or the like.

What I claim is:

1. A paper feed device for a printer, comprising:
instructing means for instructing paper feed;
holding means for holding an instructed state established by said instructing means;
pulse generating means for producing a pulse train during the period the instructed state is held by said holding means;
driving means for driving feed of a paper sheet in response to production of the pulse train by said pulse generating means;
detecting means for detecting when a paper sheet fed by said driving means reaches a predetermined position; and
control means for releasing the instructed state held by said holding means upon detection by said detecting means of a paper sheet reaching the predetermined position.

2. A paper feed device according to claim 1, wherein said holding means comprises a flip-flop which is set by an operation of said instructing means to instruct paper feed and which is reset by a detection by said detecting means of a paper sheet reaching the predetermined position.

3. A paper feed device according to claim 1, wherein said driving means comprises a pulse motor which is driven by the pulse train generated by said pulse generating means.

4. A paper feed device according to claim 1, wherein said detecting means comprises a light-emitting diode and a phototransistor with optical axes thereof being aligned with each other.

5. A paper feed device for a printer having an output port, comprising:

instructing means for instructing paper feed;

holding means for holding an instructed state established by said instructing means;

pulse generating means, including a first one shot circuit responsive to the instructed state held by said holding means for producing a pulse of predetermined duration and a second one shot circuit for producing a control pulse to said said first one shot circuit to allow said first one shot circuit to produce a pulse train;

driving means for driving feed of a paper sheet in response to the production of the pulse train produced by said pulse generating means; and paper detecting means, arranged in the vicinity of the paper output port of said printer, for detecting the paper sheet fed by said driving means and for releasing the instructed state held by said holding means upon detection of the paper sheet.

6. A paper feed device according to claim 5, wherein said holding means comprises a flip-flop which is set by an operation of said instructing means to instruct paper feed and which is reset by a detection by said detecting means of the paper sheet.

7. A paper feed device according to claim 5, wherein said driving means comprises an n-phase pulse motor which is driven by the pulse train generated by said pulse generating means, and a pulse motor control circuit for controlling said n-phase pulse motor.

8. A paper feed device according to claim 5, wherein said detecting means comprises a light-emitting diode and a phototransistor with optical axes thereof being aligned with each other.

9. A paper feed device for a printer having an output port, comprising:

instructing means for instructing paper feed;

holding means for holding an instructed state established by said instructing means;

pulse generating means for producing a pulse train during the period of the instructed state held by said holding means;

driving means for driving feed of a paper sheet in response to the production of the pulse train produced by said pulse generating means, said driving means comprising an n-phase pulse motor which is driven by the pulse train produced by said pulse generating means, and a pulse motor control circuit for controlling said n-phase pulse motor; and paper detecting means, arranged in the vicinity of the paper output port of said printer, for detecting the paper sheet fed by said driving means and for releasing the instructed state held by said holding means upon detection of the paper sheet.

10. A paper feed device according to claim 9, wherein said holding means comprises a flip-flop which is set by an operation of said instructing means to instruct paper feed and which is reset by a detection by said detecting means of the paper sheet.

11. A paper feed device according to claim 9, wherein said pulse generating means comprises a first one shot circuit for producing a pulse of a predetermined duration to drive said driving means, and a second one shot circuit for producing a control pulse to said first one shot circuit to allow said first one shot circuit to produce the pulse train.

12. A paper feed device according to claim 9, wherein said detecting means comprises a light-emitting diode and a phototransistor with optical axes thereof being aligned with each other.

13. A paper feed device for a printer having an output port, comprising:

instructing means for instructing paper feed;

holding means for holding an instructed state established by said instructing means;

pulse generating means for producing a pulse train during the period of the instructed state held by said holding means;

driving means for driving feed of a paper sheet in response to the production of the pulse train produced by said pulse generating means, and paper detecting means, including a light-emitting diode and a phototransistor with optical axes thereof being aligned with each other, arranged in the vicinity of the paper output port of said printer, for detecting the paper sheet fed by said driving means and for releasing the instructed state held by said holding means upon detection of the paper sheet.

14. A paper feed device according to claim 13, wherein said holding means comprises a flip-flop which is set by an operation of said instructing means to instruct paper feed and which is reset by a detection by said detecting means of the paper sheet.

15. A paper feed device according to claim 13, wherein said pulse generating means comprises a first one shot circuit for producing a pulse of a predetermined duration to drive said driving means, and a second one shot circuit for producing a control pulse to said first one shot circuit to allow said first one shot circuit to produce the pulse train.

16. A paper feed device according to claim 13, wherein said driving means comprises an n-phase motor which is driven by the pulse train generated by said pulse generating means, and a pulse motor control circuit for controlling said n-phase pulse motor.

17. A paper feed device for a printer, comprising:

instructing means for instructing paper feed;

holding means for holding the instructed state established by said instructing means and producing a signal during the period that the instructed state is so held;

pulse generating means for generating a pulse with a fixed period in response to said signal produced from said holding means;

driving means for driving feed of a paper sheet in response to the pulse generated by said pulse generating means;

paper detecting means arranged at a predetermined place for detecting a paper sheet fed by said driving means; and control means for releasing the instructed state held by said holding means upon detection of said paper sheet by said detecting means.

18. A paper feed device for a printer, comprising:

instructing means for instructing paper feed;

pulse generating means for generating pulses in response to the instruction issued by said instructing means;

driving means for driving feed of a paper sheet in response to the pulses generated by said pulse generating means; and control means for inhibiting the instruction issued by said instructing means upon detection of a paper sheet fed by said driving means to a predetermined position.

* * * * *

UNITED STATES PATENT AND TRADEMARK OFFICE

CERTIFICATE OF CORRECTION

PATENT NO. : 4,467,949

DATED : August 28, 1984

INVENTOR(S) : SHINICHI NAKATA

It is certified that error appears in the above-identified patent and that said Letters Patent is hereby corrected as shown below:

Column 3, line 32, between "OS1" and "to" insert --goes--.

Column 5, line 18 (Claim 5, line 10), delete "said" (first occurrence).

Signed and Sealed this

*Second* Day of *July 1985*

[SEAL]

*Attest:*

DONALD J. QUIGG

*Attesting Officer* *Acting Commissioner of Patents and Trademarks*